US005229565A

United States Patent [19]

Pressouyre

[11] Patent Number: 5,229,565

[45] Date of Patent: Jul. 20, 1993

[54] MICROWAVE OVEN WITH ROTATING TRAY

[75] Inventor: Gérard Pressouyre, Le Chateau D'Olonne, France

[73] Assignee: Thomson Electromenager, Boulogne-Billancourt, France

[21] Appl. No.: 953,814

[22] Filed: Sep. 30, 1992

Related U.S. Application Data

[62] Division of Ser. No. 636,728, Jan. 2, 1991.

[30] Foreign Application Priority Data

Jan. 5, 1990 [FR] France ..... 90 00076

[51] Int. Cl.[5] ..... H05B 6/78

[52] U.S. Cl. ..... 219/10.55 F

[58] Field of Search ..... 219/10.55 F, 10.55 E, 219/10.55 R

[56] References Cited

U.S. PATENT DOCUMENTS 3,849,623 11/1974 Gilliatt ..... 219/10.55 R
4,424,431 1/1984 Gurubatham ..... 219/10.55 F
4,636,605 1/1987 Berend et al. ..... 219/10.55 F
4,757,173 7/1988 Park ..... 219/10.55 F
5,166,486 11/1992 Komatsu et al. ..... 219/10.55 F

FOREIGN PATENT DOCUMENTS 845849 12/1976 Belgium .
52-36348 3/1977 Japan ..... 219/10.55 F
2162728 2/1986 United Kingdom .

*Primary Examiner*—Philip H. Leung
*Attorney, Agent, or Firm*—Oblon, Spivak, McClelland, Maier & Neustadt

[57] ABSTRACT

A microwave oven provided, in its chamber, with a rotating tray designed to receive items or products subjected to a processing operation, includes, as a rotating tray, a tray which, during this processing operation, puts these items or products into motion along a non-circular path in this processing chamber.

A mechanism for rotating the tray along the non-circular path is also provided.

1 Claim, 2 Drawing Sheets

FIG. 1
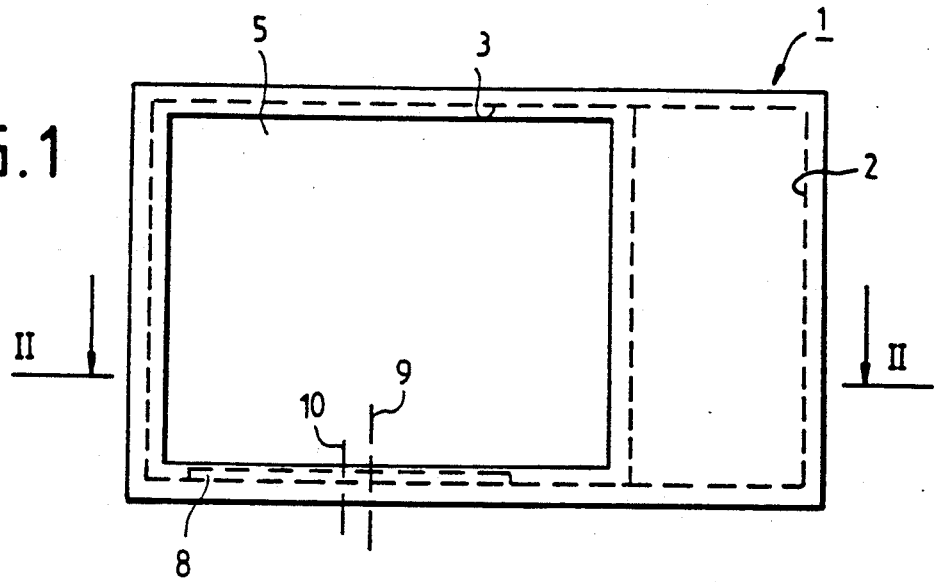
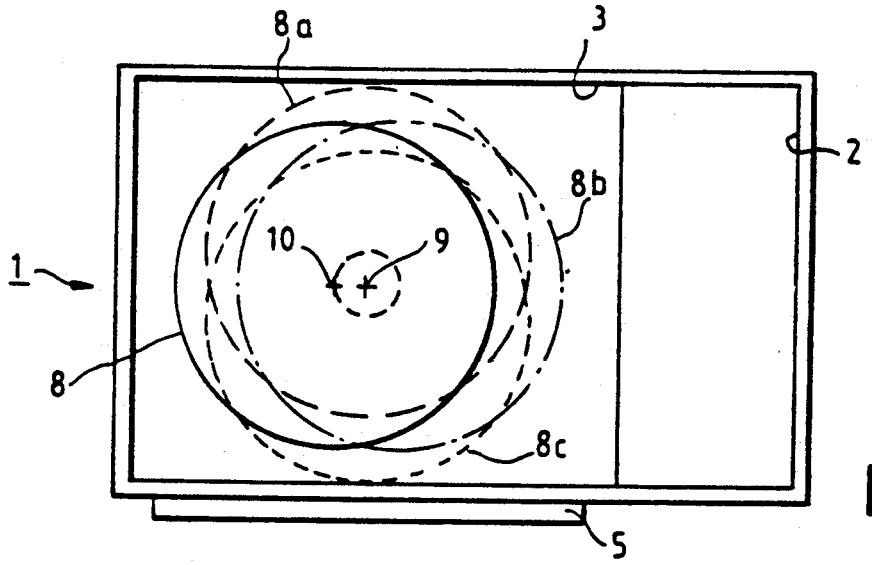
FIG. 2
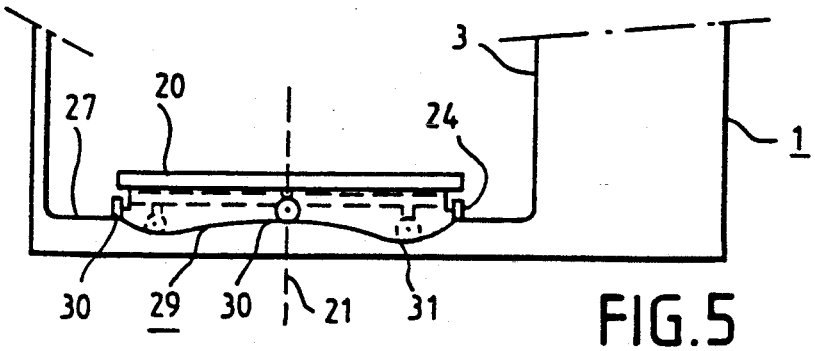
FIG. 5

MICROWAVE OVEN WITH ROTATING TRAY

This is a division of application Ser. No. 07/636,728, filed on Jan. 2, 1991.

BACKGROUND OF THE INVENTION

1. Field of the Invention

The present invention relates to a microwave oven with rotating tray.

A microwave oven usually has a compartment used as a processing chamber and a compartment designed to house a magnetron system for the production of microwaves. The microwaves produced by the production system are conveyed by a waveguide to the processing chamber where a food item or food product, subjected to a process of cooking, heating or defreezing, is placed. If this food item or food product remains immobile within this chamber during this processing operation, the microwaves, in their standing wave mode in this chamber, cause the mass of this food item or food product to be processed non-uniformly. In other words, in the mass of this food item or food product, there are zones that are more cooked or well heated or well defrozen alternating with zones that are less cooked, still cold or badly defrozen.

2. Description of the Prior Art

Several methods have been proposed to make this processing uniform in the mass of this food item. In one of the known approaches, a device for stirring the microwaves is mounted in the oven, at the output of a waveguide, in order to obtain a complex standing wave mode of microwaves in the processing chamber This approach improves the result obtained but the processing is still far from being uniform throughout the mass of the item or product subjected to this processing stage. Another known approach provides for a rotating tray within the processing chamber of the oven. This rotating tray has a fixed, concentric axis of rotation and is designed to receive an item or product subjected to a processing operation. During this processing operation, the rotating tray with a concentric axis of rotation enables the continual changing of the position of the item or product in the chamber by exposing it to the microwaves. The result obtained shows that, in the mass of the item or product subjected to this processing operation, there are concentric zones that are well cooked or well heated or properly defrozen alternating with concentric zones that are less well cooked or still cold or badly thawed. These zones are all concentric with the fixed axis of rotation of the rotating tray.

SUMMARY OF THE INVENTION

The present invention seeks to circumvent the drawbacks of the above-mentioned known approaches and enables the making of an efficient and economical microwave oven that provides uniform processing throughout the mass of the item or product subjected to processing in its chamber According to the invention, there is proposed a microwave oven provided, in its chamber, with a rotating tray designed to receive items or products subjected to a processing operation, wherein said microwave oven has, as a rotating tray, a tray which, during the processing, rotates and puts these items or products into motion along a non-circular path in this processing chamber.

BRIEF DESCRIPTION OF THE DRAWINGS

For a clearer understanding of the invention, a certain number of exemplary embodiments are described hereinafter and illustrated by the appended drawings, of which:

FIG. 1 shows a partial, schematic front view of a microwave oven according to a first exemplary embodiment of the invention;

FIG. 2 shows a partial, schematic view, in a horizontal section taken along line II—II through the microwave oven of FIG. 1;

FIG. 5 shows a partial, schematic view, in a vertical section, of a microwave oven according to a third exemplary embodiment.

DESCRIPTION OF PREFERRED EMBODIMENTS

Figure 3:
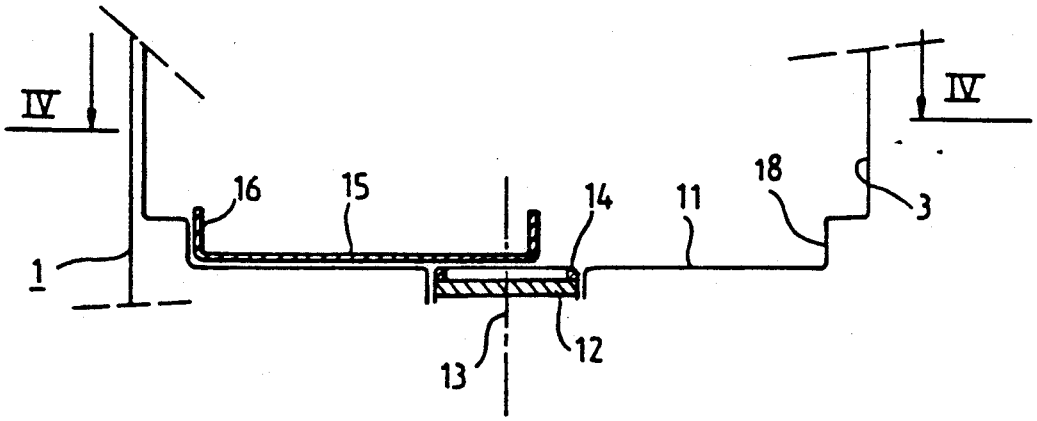
FIG. 3 shows a partial, schematic view, in vertical section, of the microwave oven according to a second exemplary embodiment.

A microwave oven 1 according to an exemplary embodiment shown in FIGS. 1 and 2 includes two compartments 2, 3, namely a compartment 2 designed to house a microwave production system (not shown) and a compartment 3 serving as a processing chamber. The compartment 3 is closed by a door 5. The microwaves produced by the system housed in the compartment 2 are conveyed to the processing chamber 3 by a waveguide (not shown). The microwaves therein sustain a standing wave mode, penetrate the food items or products placed in this chamber 3 and carry out a cooking, heating or defreezing operation.

According to the invention, a microwave oven has, as a rotating tray in its processing chamber, a tray that receives items or products subjected to a processing operation and, during this processing operation, puts these items or products into motion along a non-circular path in this processing chamber.

The path followed by these items or products subjected to a processing operation is either a complex curve in a horizontal plane or a three-dimensional curve in space.

By means of this path, all the parts of the food items or products subjected to the processing are presented by this rotating tray to the microwaves in the processing chamber 3. Consequently, the cooking, heating or defreezing is done uniformly throughout the mass of these articles or products.

According to a first exemplary embodiment illustrated in FIG. 2, the microwave oven 1 has, as a rotating tray in its processing chamber 3, a horizontal tray rotating about an off-centered vertical axis 9, the center of the tray being indicated by the reference 10.

Because its axis of rotation 9 is off-centered, the horizontal tray 8 is positioned, at each moment, in a new position that is different from the previous position, in the processing chamber 3. Three successive positions, according to which the horizontal tray 8 is positioned in the processing chamber 3 after three rotations by an angle of 90 degrees each, are shown as an example by means of broken lines referenced 8*a*, 8*b*, 8*c* in FIG. 2. The path of the items or products put into motion in the chamber 3 by this horizontal tray 8 is a non-circular path in a horizontal plane.

By means of their non-circular path, the different paths of the items and products (which are not shown) placed on this tray 8 are all presented by this tray 8 to the microwaves in the processing chamber 3.

Figure 4:
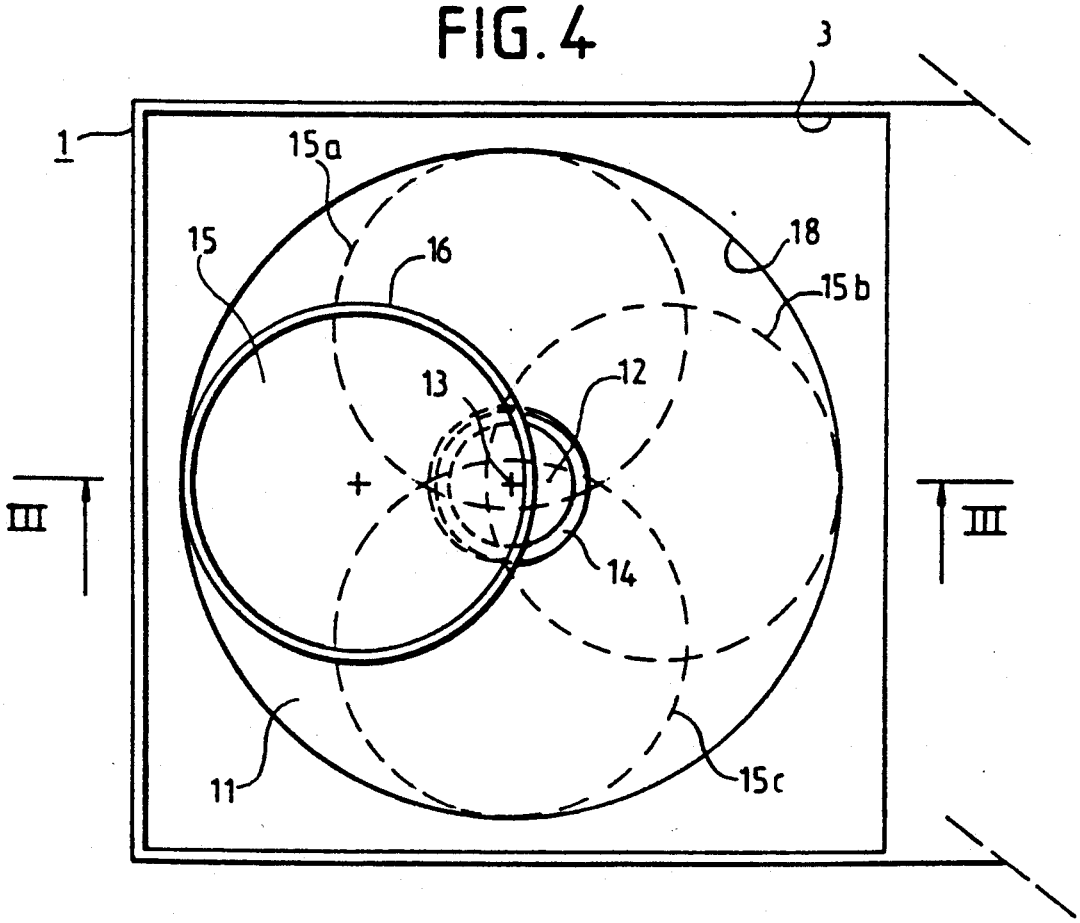
FIG. 4 shows a partial, schematic view, in a horizontal section taken along the line IV—IV through the microwave oven of FIG. 3.

According to a second exemplary embodiment shown partially and schematically in FIGS. 3 and 4, in the processing chamber 3, the microwave oven 1 has, firstly, a fixed, circular, hollow, horizontal bottom 11 and a movable, horizontal driving disk 12 mounted so as to rotate concentrically with this bottom in a central aperture of this bottom, about a fixed vertical axis 13, this disk 12 being provided, on the rim of its upper surface, with a circular friction piece 14 having a high coefficient of friction Secondly, in the processing chamber 3, the microwave oven 1 has, as a rotating tray, an unfixed tray 15 with a circular shoulder 16 positioned, without any fastening elements, in the fixed, circular, hollow, horizontal bottom 11 and straddling the movable driving disk 12.

During rotation of the horizontal driving disk 12 about its axis 13, the circular friction piece 14 with a high friction coefficient tends to shift the unfixed tray 15, to push it towards the periphery of the circular hollow bottom 11 against the shoulder 18 of this bottom and to force it to rotate in rolling on the shoulder 18 and in sliding on the surface of this hollow horizontal bottom 11. Several positions of this unfixed tray 15 on the hollow, horizontal bottom 11 are indicated in broken lines 15*a*, 15*b*, 15*c* in FIG. 4. The path of the items or products subjected to processing in the chamber 3 and borne by the unfixed tray 15, which is rotated and shifted on the hollow, horizontal bottom 11 by the driving disk 12, is a non-circular path in a horizontal plane. By means of their non-circular path, the different paths of the items or products (not shown) laid on this unfixed tray 15 ar all presented by this tray 15 to the microwaves e in the processing chamber 3.

According to a third exemplary embodiment shown schematically and partially in FIG. 5, in the processing chamber 3, the microwave oven 1 has firstly, as a rotating tray, a circular horizontal tray 20 rotating about a concentric vertical axis 21, mounted so that it moves freely on this vertical axis 21, this tray 20 being provided, on the rim of its lower circular surface, with at least three castor wheels 24 with horizontal axes of rotation, angularly spaced out and aligned on a circular line. Secondly, the microwave oven has, in the processing chamber 3, on the bottom wall 27 of this chamber 3, a circular running track 29 for the castor wheels 24, concentric to the vertical axis of rotation 21 of the circular horizontal tray 20, having a diameter equal to that of the circular line of alignment of these castor wheels 24 and being formed by an alternating succession of a number of angularly spaced out bosses 30 and hollows 31, this number being the same as the number of the castor wheels 24 of the tray 20 or a multiple of this number.

In rotation of the tray 20, when all the castor wheels 24 are on the peaks of the bosses 30 of the running track 29, the tray 20 reaches it maximum top position shown in unbroken lines in FIG. 5 and when the castor wheels 24 are in the bottoms of the hollows 31 of the running track 29, the tray descends to its maximum bottom position shown in broken lines in figure 5.

In its rotation, the horizontal tray 20 oscillates vertically between its maximum top position shown in solid lines and its maximum low position shown in broken lines in FIG. 5.

The path of the items or products borne by this tray 20 is a non-circular path forming a three-dimensional curve in space.

By means of their non-circular path, the different parts of the articles or products (which are not shown), placed on the rotating tray 20, are all presented to the microwaves in the processing chamber 3.

In one alternative embodiment (not shown), the castor wheels 24 of the tray 20 and the circular running track 29 are replaced by an equivalent system with cams and cam followers or an equivalent screw system, of a known type, enabling this tray 20 to rotate about a vertical axis and oscillate simultaneously along this axis.

Through, the invention, the cooking, heating or thawing of an item or product in the processing chamber 3 of the microwave oven 1 is advantageously uniform throughout the mass of this item or product.

What is claimed is:

1. A microwave oven, which comprises:

a chamber;

a rotating tray located in said chamber for receiving items subject to microwave processing operation, wherein said tray is rotatable during the processing and puts said items into motion along a non-circular path in said processing chamber and wherein said chamber has a bottom with a central aperture formed therein; and means for contacting said rotating tray at a position which is off-centered from a central position of said tray for moving said tray along said non-circular path wherein said means for contacting said tray comprises a movable, horizontal driving disk mounted so as to rotate concentrically in said central aperture about a fixed, vertical axis, said driving disk having, on a rim of an upper surface thereof, a circular friction piece having a high coefficient of friction and wherein said rotating tray comprises an unfixed tray with a circular shoulder positioned, free of any fastening elements, on the bottom of the chamber and at least partially straddling said movable driving disk.

* * * * *